US006108829A

United States Patent [19]

Wadsworth

[11] Patent Number: 6,108,829

[45] Date of Patent: Aug. 29, 2000

[54] PORTABLE HOT TUB

[76] Inventor: A Earl Wadsworth, 6987 N. 5th West, Idaho Falls, Id. 83401

[21] Appl. No.: 08/813,449

[22] Filed: Mar. 10, 1997

[51] Int. Cl.[7] ..... A47K 3/00

[52] U.S. Cl. ..... 4/541.1; 4/541.3; 4/584

[58] Field of Search ..... 4/541.1, 541.3, 4/541.4, 546, 584, 585

[56] References Cited

U.S. PATENT DOCUMENTS

| | | | |
|---|---|---|---|
| 1,729 | 4/1840 | Tongue . | |
| 1,897 | 2/1840 | Prinsep . | |
| 21,920 | 10/1858 | Bloom . | |
| D. 23,583 | 8/1894 | Scott . | |
| 3,066,312 | 11/1962 | Reavis . | |
| 4,356,933 | 11/1982 | Connolly . | |
| 4,546,505 | 10/1985 | Wakenshaw | 4/543 |
| 4,890,343 | 1/1990 | Schlags . | |
| 4,893,362 | 1/1990 | Murphy . | |
| 5,408,707 | 4/1995 | Wilson | 4/541.1 |
| 5,527,412 | 6/1996 | Hansen et al. | 4/541.1 |
| 5,548,852 | 8/1996 | Rowe | 4/584 |

FOREIGN PATENT DOCUMENTS

| | | |
|---|---|---|
| 673.488 | 4/1929 | France . |
| 49112 | 2/1910 | Germany . |
| 549998 | 9/1956 | Italy . |

*Primary Examiner*—David J. Walczak

[57] ABSTRACT

A portable hot tub (10) having a pair of upper member covers (14) removably connectable to each other at distal ends by a pair of sliding lock members (18). The portable hot tub (10) further has at least four vertical support members (20). A portable hot tub (10) further has a tub liner (12) is securely fastened around a top periphery to the pair of upper member covers (14) by horizontal support members (13) which are inserted within a wrap of the tub liner (12) within the upper member covers (14). The portable hot tub (10) further has a jet assembly (22) removably positioned within the tub liner (12). A hose nozzle (24BAA) is connected between the first tube elbow (24BA) and an outlet hose (32). The portable hot tub (10) further has a filter assembly (26) connected to a lower end of the first tube (24B) by a filter T-connector (26A). The portable hot tub (10) further has a motor/heater unit (36) is connected to the inlet hose (30) and the outlet hose (32). An air button hose (34) is connected at one end to the motor/heater unit (36) and connected at an opposite end to an air button (28B).

17 Claims, 7 Drawing Sheets

PORTABLE HOT TUB

BACKGROUND OF THE INVENTION

1. Field of the Invention

The present invention relates generally to a bathing device, more particularly, the present invention relates to a portable hot tub device.

2. Description of Prior Art

Today there are a number of hot tubs available on the market. These hot tubs can provide relief to users suffering from injuries or other ailments treatable by hydrotherapy. Also, these hot tubs are often used for simply recreational purposes providing pleasure to its users. These prior art hot tubs are usually very heavy, cumbersome, permanently affixed and too expensive for the average consumer to afford. Therefore, there exists a need for a hot tub that is lightweight, portable and inexpensive enough for the average consumer to afford.

Numerous innovations for bathing devices have been provided in the prior art that are described as follows. Even though these innovations may be suitable for the specific individual purposes to which they address, they differ from the present invention as hereinafter contrasted.

U.S. Pat. No. 4,546,505 to Wakenshaw discloses a portable spa that has an inflatable base platform surrounded by a containment wall that is interconnected to a collapsible support structure, the base platform further having fluid directing jets. This patent differs from the present invention because it does not disclose a hot tub capable of moving from a folded position to an upright position and a separate jet assembly removably secured within the tub for movement of fluids therein, this patent further does not disclose a fluid inlet/outlet assembly that has an inlet tube connected to the jet assembly and an outlet tube extending into the hot tub, wherein the outlet tube has attached to its lower end a filter assembly with multiple fluid inlets.

U.S. Pat. No. 3,970 to Prinsep, U.S. Pat. No. 1,729 to Tongue, U.S. Pat. No. 21,920 to Bloom, U.S. Design No. 23,583 to Scott, U.S. Pat. No. 3,066,312 to Reavis, U.S. Pat. No. 4,890,343 to Schlags each disclose a bathing device. Prinsep discloses a portable bath tub that consists of a cloth canvas supported by a collapsible frame. Tongue discloses a portable bath tub consisting of a light waterproof material that is supported by a sectionally constructed top frame and detachable vertical props. Bloom discloses a portable folding bath consisting of an apparatus hinged and jointed in such a manner so that it can be fitted as a bath or collapsed. Scott discloses a design for a bath tub consisting of a body that has an outwardly projecting flange. Reavis discloses a collapsible sitz bath consisting of a plastic bottom and side that allows it to be folded into a compact shape. Schlags discloses a portable decontamination tank consisting of a tubular substructure that has a vessel portion formed from plastic film, the vessel further having a base that rests on the ground. These patents differ from the present invention because they do not disclose any jet assembly contained within the tub for movement of fluids therein, also no inlet and outlet tube structure is disclosed to either carry a fluid toward or away from the tub, a filter assembly with multiple water inlets is further not disclosed.

U.S. Pat. No. 5,408,707 to Wilson discloses a collapsible tub but does not contain a support structure composed of vertical and horizontal members attached by means of covers. The support structure of the Wilson patent is integral to the sidewall and floor combination. The Wilson patent further does not disclose a fluid inlet/outlet assembly that has an inlet tube connected to the jet assembly and an outlet tube extending into the hot tub, wherein the outlet tube has attached to its lower end a filter assembly with multiple fluid inlets.

The present invention, in contrast, incorporates at least two upper and lower member covers that enclose the vertical support members. This particular configuration allows a gap to be formed between the respective ends of the four horizontal support members. This gap allows the tub liner to fold in half when in the collapsed position. This is a distinctly different configuration than in the Wilson patent. In the present invention, the support structure is a separate structure which is inserted into the liner allowing the spa to be rigid.

U.S. Pat. No. 4,893,362 to Murphy discloses a portable spa having a vertically rigid side wall, and a flexible inner including inflatable seat chambers which may be connected in series for filling with a fluid and inflatable backrest chambers which are partially filled with fluid and air.

In contrast, the present invention contains a decidedly different support structure from either Murphy or Wilson. The present invention's support structure is composed of horizontal support members interconnected with a plurality of vertical support members which form a frame and give support to the hot tub. Wilson, as has been stated, uses its composite wall and floor for its structural integrity. Murphy has its structure supported by inflatable chambers which are integral with the walls of the spa. Like the Wilson patent, the support structure cannot be removed from the spa and dissembled or replaced. The present invention provides the opportunity for the user to replace a broken structural element where Murphy and Wilson cannot.

U.S. Pat. No. 4,356,933 to Connolly discloses a container for fluent material having a limp flexible bottom and an upstanding limp flexible perimetral circular wall. The wall is kept upstanding by flexible support means between the upper edge of the wall and the upper horizontal member of a framework surrounding and spaced from the perimetral wall. The wall is of a water-proof woven synthetic fabric with the warp running lengthwise around the wall and the weft upright. The fabric has a strength to weight ratio and stretch characteristic sufficient that the wall requires no internal reinforcement or external support against outward pressure from contents when filled into the container.

In contrast, the present invention incorporates a plurality of member covers which fit over the ball members and this combination provides the linkage between the horizontal support members and the vertical support members. This structure is not present in the Connolly patent. Examination of the Connolly patent reveals a cylindrical woven fabric tank, with a limp and flexible perimetral circular wall. The structure for connection between the horizontal and vertical members are by T-shaped rods in the Connolly invention. This is a decidedly different structure from the current invention.

Numerous innovations for bathing devices have been provided in the prior art that are adapted to be used. Even though these innovations may be suitable for the specific individual purposes to which they address, they would not be suitable for the purposes of the present invention as heretofore described.

SUMMARY OF THE INVENTION

In according with the present invention, the portable hot tub consists of a tub liner capable of holding a volume of fluid when supported in an upright position The tub liner is supported in the upright position by a collapsible support structure. This support structure consists of a plurality of horizontal and vertical members. Removably secured within the tub liner is a jet assembly capable of circulating a fluid therein. Attached to the jet assembly is an inlet tube for carrying a fluid to the hot tub. Extending into the tub liner is an outlet tube for carrying a fluid away from the hot tub, wherein the outlet tube has attached to its lower end a filter assembly that has multiple fluid inlets.

Broadly considered, the invention comprises a portable hot tub device that has a travel configuration and a ready to use configuration. When in the travel configuration, the portable hot tub will collapse into a portable and compact package. While in the ready to use configuration, the portable hot tub readily assembles into an efficient and easy to use hot tub device. Once the portable hot tub is assembled, a motor/heater unit will be attached to the inlet and outlet tubes by two flexible hoses. Then the portable hot tub will be filled up with fluid, which the motor/heater unit will begin to heat and circulate through out the jet assembly. This will cause the heated fluid to be circulated within the tub liner providing hydrotherapy to users contained therein.

Accordingly, it is an object of the present invention to provide a bathing device.

More particularly, it is an object of the present invention to provide a portable hot tub device.

In keeping with these objects, and with others which will become apparent hereinafter, one feature of the present invention resides, briefly stated, in that the portable hot tub can provide the same hydrotherapy as the more expensive, heavier and larger hot tubs on the market.

When the portable hot tub is designed in accordance with the present invention, it can provide the user with a portable, light weight, compact and inexpensive hot tub device.

In accordance with another feature of the invention, the portable hot tub can be used in the home as well as in recreational vehicles.

Another feature of the present invention is that the motor/heater unit plugs into any 110 volt and 15 amp electrical outlet.

An additional feature of the present invention provides a hot tub without the use of and additional external filtering device which is cumbersome, expensive and heavy to carry. The present invention utilizes a removable and/or reusable and/or disposable filtering device within the hot tub itself to filter the water contained therein.

Yet another feature of the present invention is that the filter assembly has three water inlets provides additional safety than the required two inlet systems.

Still another feature of the present invention is that it can be easily stored or shipped.

Yet still another feature of the present invention is that it is economical to maintain and use.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

BRIEF LIST OF REFERENCE NUMERALS UTILIZED IN THE DRAWING

10—portable hot tub (10)
11—holder strip (11)
12—tub liner (12)
12A—retaining members (12A)
12B—upper gaps (12B)
12C—lower gaps (12C)
13—horizontal support members (13)
14—pair of upper member covers (14)
14A—upper ball members (14A)
16—pair of lower member covers (16)
16A—lower ball members (16A)
18—sliding lock members (18)
20—vertical support members (20)
20A—vertical support member slotted end (20A)
20B—vertical support member slanted end (20B)
20C—vertical support member anchor (20C)
22—jet assembly (22)
22A—jet assembly members (22A)
22C—jets (22C)
22CA—knurled ring (22CA)
22D—extended jet (22D)
22DA—front T-member (22DA)
24—inlet/outlet assembly (24)
24A—second tube (24A)
24B—first tube (24B)
24AA—second tube elbow (24AA)
24AB—rear T-member (24AB)
24BA—first tube elbow (24BA)
24BB—first tube bottom end (24BB)
24BAA—hose nozzle (24BAA)
24C—inlet/outlet cross member (24C)
24D—inlet jet (24D)
24DA—inlet jet aerator nozzle (24DA)
26—filter assembly (26)
26A—filter T-connector (26A)
26AA—filter T-connector lower portion (26AA)
26AB—filter T-connector upper portion (26AB)
26B—filter screens (26B)
26C—filter pipe (26C)
26CA—filter pipe orifices (26CA)
26E—filter element (26E)
28—inlet/outlet bracket (28)
28A—bracket knob (28A)
28B—air button (28B)
28C—inlet/outlet bracket anchor (28C)
30—inlet hose (30)
32—outlet hose (32)
34—air button hose (34)
36—motor/heater unit (36)
110—second portable hot tub (110)
122—second jet assembly (122)
124A—second primary tube (124A)
124AA—second primary tube elbow (124AA)
124BA—second first tube elbow (124BA)
124B—second first tube (124B)
124BAA—second hose nozzle (124BAA)
129—second connector patch (129)

DETAILED DESCRIPTION OF THE PREFERRED EMBODIMENT

Figure 1:
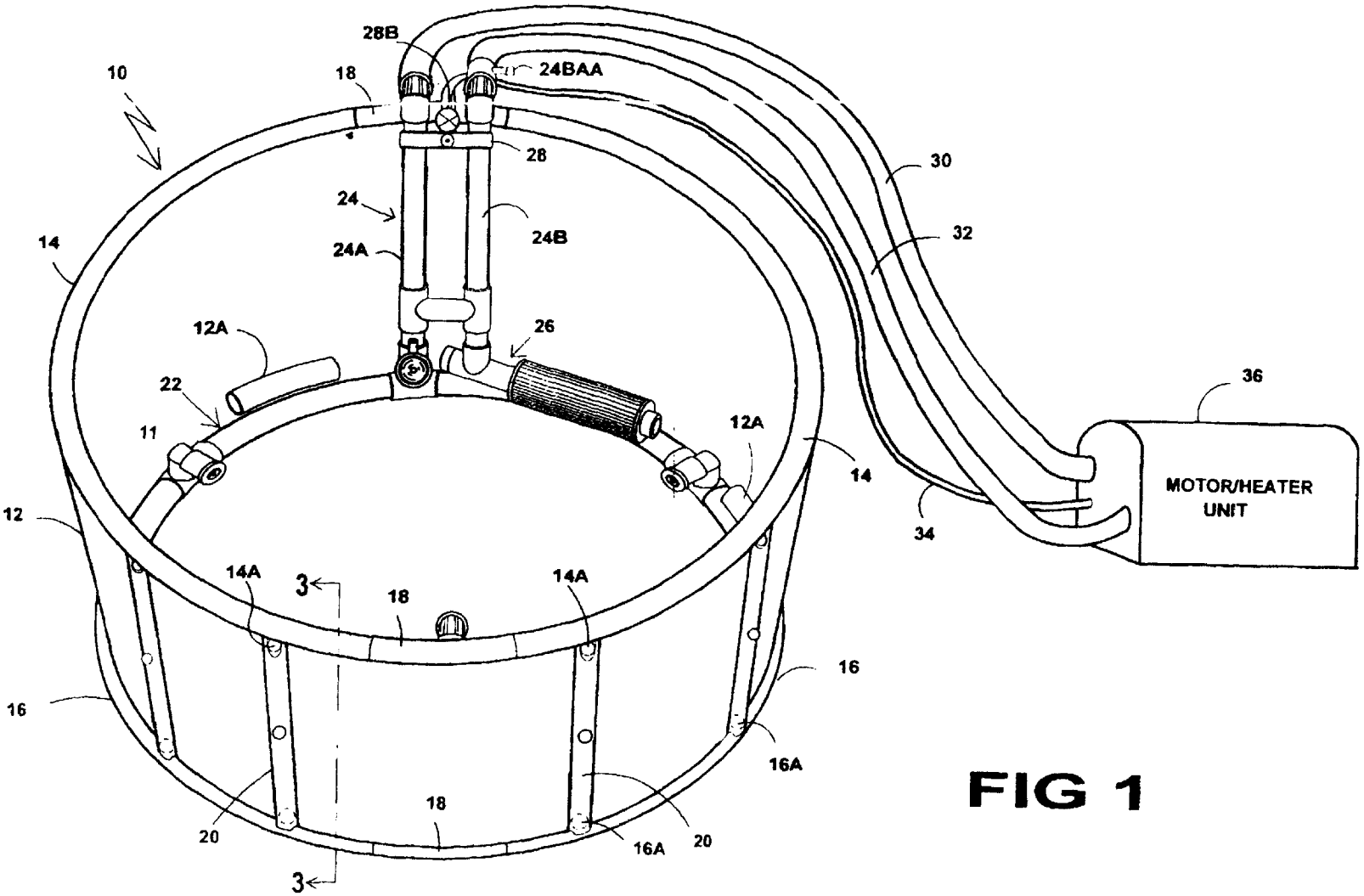
FIG. 1 is a perspective view of the portable hot tub in the ready to use configuration showing the tub liner supported in the upright position.

Firstly, referring to FIG. 1 which is a perspective view of the portable hot tub (10) in the ready to use configuration where the tub liner (12) is supported in the upright position. The tubliner (12) consists of a continuous side wall extending upward from an outer periphery of a circular bottom wall defining an inner space therein. The tub liner (12) is preferably fabricated from a flexible material that can be easily moved to a collapsed position and then folded. This material is preferably strong enough to support a large volume of fluid within the inner space of the tub liner (12) when in the upright position. Such materials would include either polyvinyl or nylon-vinyl having a weight ranging from 18 to 22 ounces.

Enclosing and extending around the upper edge of the tub liner (12) is the pair of upper member covers (14). Enclosing and extending around the lower edge of the tub liner (12) is the pair of lower member covers (16). The pair of upper 16 member covers (14) and the pair of lower member covers (16) are each of a length so that they do not completely extend around the entire upper and lower edges of the tube liner (12). This configuration provides a gap between the respective ends of the pair of upper member covers (14) and the pair of lower member covers (16), which will allow the tube liner (12) to be folded in half when in the collapsed position. The upper member covers (14) has a larger diameter than the diameter of the pair of lower member covers (16) functioning to allow the upper member covers (14) to fold down over the lower member covers (16) for thinner compactness during transportation.

When the tube liner (12) is in the upright position these gaps are covered by the sliding lock members (18). The sliding lock members (18) are of a slotted tubular configuration having a preferred length of approximately 8 inches, wherein the edges of the slot can be separated so that the sliding locking member can be placed over the respective ends of the pair of upper member covers 14 and the pair of lower member covers (16).

Extending downward from the front surface of the pair of upper member covers (14) are upper ball members (14A). Extending upward from the front surface of the pair of lower member covers (16) are lower ball members (16A). The upper ball members (14A) and lower ball members (16A) allow each of the vertical support members (20) to be removably attached between the pair of upper member covers (14) and the pair of lower member covers (16). There are an equal number of vertical support members present corresponding to the number of upper ball members and lower ball members. The portable hot tub (10) having a pair of upper member covers (14) removably connectable to each other at distal ends by a pair of sliding lock members (18). Each of the upper member covers (14) comprise at least two upper ball members (14A) extending downwardly therefrom.

The portable hot tub (10) further has a pair of lower member covers (16) removably connectable to each other at distal ends by a pair of sliding lock member (18). Each of the lower member covers (16) comprise at least two lower ball members (16A) extending upwardly therefrom, the upper ball members (14A) and the lower ball members (16A) are complimentary positioned to one another. The portable hot tub (10) further has at least four vertical support members (20) which each comprise a vertical support member slotted end (20A). A vertical support member slanted end (20B), and a vertical support member anchor (20C). Each vertical support member (20) is removably insertable into the upper ball members (14A) by the vertical support member slotted end (20A). Each vertical support member (20) is removably insertable into the lower ball members (16A) by the vertical support member slanted end (20B). A portable hot tub (10) further has a tub liner (12) which is securely fastened around a top periphery to the pair of upper member covers (14) by horizontal support members (13) which are inserted within a wrap of the tub liner (12) within the upper member covers (14). The tub liner (12) is securely fastened around a bottom periphery to the pair of lower member covers (16) by horizontal support members (13) which are inserted within a wrap of the tub liner (12) within the lower member covers (16). The vertical support member anchors (20C) securely fasten to a middle of the tub liner (12) functioning to prevent bulging thereof. The tub liner (12) further comprises at least one retaining member (12A) which is securely fastened to an inside of a bottom periphery of the tub liner (12).

The motor/heater unit (36) is connected to the inlet hose (30) and the outlet hose (32) air button hose (34) is connected at one end to the motor/heater unit (36) and connected at an opposite end to an air button (28B). When a user depresses the air button (28B) pressurized air enters the air button hose (34) activating/deactivating the motor/heater unit (36). There is a diaphram in the air button, which is standard and well known in the art, that forces pressurized air through the air tubes to activate a switch in the motor/heater control unit (36).

The upper member covers (14), the lower member covers (16), and the vertical support members (20) are manufactured from a material selected from a group consisting of plastics, plastic composites, metals, metal alloys, rubber, rubber composites, and poly-vinyl chloride.

The tub liner is fabricated from a material selected from a group consisting of plastics, plastic composites, metals, metal alloys, rubber, rubber composites, poly-vinyl and nylon-vinyl.

Figure 2:
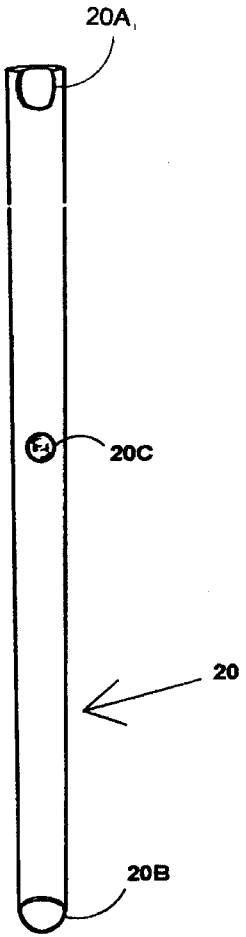
FIG. 2 is a front view of one of the vertical support members.

Now referring to FIG. 2 which is a front view of one of the eight vertical support members (20). The vertical support members supply vertical support to hold the tub liner (12) in the upright position. Each of the vertical support members (20) is of a tubular configuration having a length of 22 inches. Each vertical support members (20) has vertical support member slotted end (20A) and vertical support member slanted end (20B). The vertical support member slanted end is required because when supporting the tub liner (12) in the upward position, the vertical support members (20) extend upward at a slightly outward angle. This is because the upper edge of the tub liner (12) has a diameter three inches longer than the lower edge of the tub liner (12). Also, located on the middle front surface of each of the support members (20) is vertical support member anchor (20C), which provides a place to tie a cover string around.

Referring back to FIG. 1, each vertical support member (20) is removably attached to the pair of upper member covers (14) and the pair of lower member covers (16) by placing the vertical support member slanted end (20B) over each of the lower ball members (16A) and pressing the vertical support member slanted end (20A) onto the upper ball members (14A) thereby engaging each upper ball member (14A). Then each vertical support member (20) is rotated 180 degrees into place as shown in FIG. 1. When the tub liner (12) is filled with fluid, the vertical support members (20) will be held in place as shown by the weight of the fluid pressing the tub liner adjacent against the back of the vertical support members (20). The vertical support members (20) can only be removed when the tub liner (12) is drained.

Figure 8:
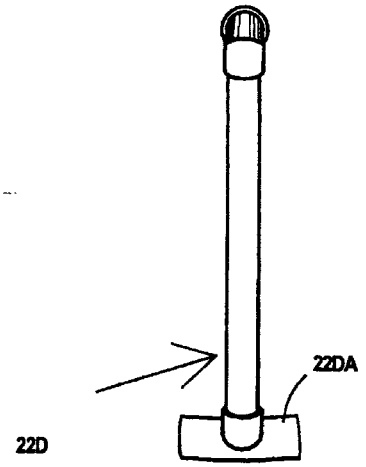
FIG. 8 is rear perspective view of the extended jet.

Contained within the lower portion of the tube liner (12) are the retaining members (12A). The retaining members (12A) preferably consist of four 2 inch segments of vinyl tubing that are either riveted or glued to the inner surface of the side wall of the tub liner (12). When the jet assembly is installed in the tub liner (12) the four retaining members (12A) will rest on top of the tub liner (12), thereby removably securing the jet assembly (22) to the lower portion of the inner space of the tub liner (12). When the portable hot tub (10) is being used, the jet assembly (22) circulates the fluid contained within the tub liner (12) providing a whirlpool affect. When the jet assembly (22) is circulating the fluid, the jet assembly (22) must be secured within the inner space of the tub liner (12) to prevent it from moving around. At least one holder strip (11) snap into water supply tubes holding them together in one complete circle. At least one holder strip (11) is manufactured from plastic or fabric. The jet assembly 22 is positioned at the bottom of the tub via retaining members 12A. However, the complete jet assembly (22) can be pivoted at location (12AA) and be raised and lowered by the user. Also 24D, FIG. 13 pivots down and up at location 22DA. FIG. 8 and the jet unit upper end 13AA rotates either direction as the bather desires for complete back and front body therapy.

Extending upward from the rear portion of the jet assembly (22) is the second tube (24A), which carries the fluid to the jet assembly (22). Extending downward into the tube liner (12) is the first tube (24B), which carries the fluid out of the tub liner (12). Attached to the lower end of the first tube (24B) is the filter assembly (26), which filters out any impurities from the fluid drawn into the first tube (24B). The hose nozzle (24BAA) extends outwardly from the upper end of the first tube (24B). The hose nozzle (24BAA) contains a threaded female fitting that allows it to be attached to a garden hose for filling the tub liner (12) with fluid. Contained within the hose nozzle (24BAA) is a valve that closes so that no fluid can escape from the hose nozzle (24BAA) after the tub liner (12) is filled with the fluid. The second tube (24A) and first tube (24B) are attached to each other forming the inlet/outlet assembly (24).

The inlet/outlet assembly (24) is removably secured within the tub liner by the inlet/outlet bracket (28). Attached to the inlet/outlet bracket is the air button (28B), which will generate a burst of air when the air button (28B) is depressed. The burst of air is used to activate a bellow switch contained within the motor/heater unit (36). Attached to the rear of the air button (28B) is one end of the air button hose (34), which will carry the burst of air generated by the air button (28B) to the motor/heater unit (36). The inlet hose (30) and outlet hose (32) preferably should have a diameter of approximately 1½ inches, which will connect the motor/heater unit (36) to the second tube (24A) and first tube (24B). This will allow the motor/heater (36) unit to draw the fluid from the tub liner (12) through the outlet hose (32) to heat the fluid and then pump the heated fluid back through the inlet hose (30). The motor/heater 36 unit is a standard 110 volt and 15 amp model are standard in the art. The motor/heater unit (36) can be remotely turned on and controlled by a burst of air that activates a bellow switch contained within the motor/heater unit (36).

Figure 3:
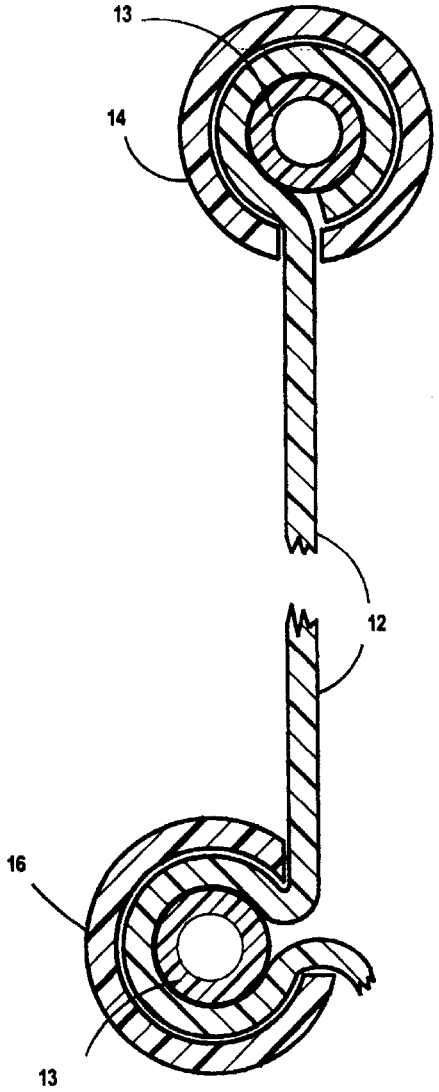
FIG. 3 is a cross sectional view of the front first side of the tub liner.

Referring to FIG. 3 which is a cross sectional view of the front first side of the tub liner (12) along line 3—3 of FIG. 1. This view shows two horizontal support members (13) attached to both the upper first edge and the lower first edge of the tub liner (12). The horizontal support members are attached to the tub liner (12) either by a glueing or riveting process. Each of the first horizontal support members (13) are of the same tubular design which provides lateral support to the tub liner (12). One of the upper member covers (14) and one of the lower member covers (16) enclose the first upper edge and first lower edge of the tub liner, thereby protecting the joint between the tub liner (12) and the horizontal support members (13).

The pair of upper member covers (14) and the pair of lower member covers (16) are of a slotted tubular configuration. The two edges of the slot of one of the upper member covers (14) and one of the lower member covers (16) can be separated and placed over the first upper and lower edges of the tub liner (12), thereby locking them in place as shown.

The second side of the tub liner is similarly configured as the first. Attached to the second upper edge and second lower edge of the tub liner (12) are two more horizontal support members (not shown). Each of the four horizontal support members (13) have lengths equal to the pair of upper member covers (14) and the pair of lower member covers (16) removably positioned at opposite distal ends.

The vertical support members (20), the pair of upper member covers (14), the pair of lower member covers (16) and four horizontal support members are one embodiment of the collapsible support means. These parts can be fabricated from any strong light weight plastic or metal. Although, the preferred material is poly vinyl chloride. Each of the vertical supports (20) preferably should be fabricated from a schedule 40 poly vinyl chloride material.

Figure 4:
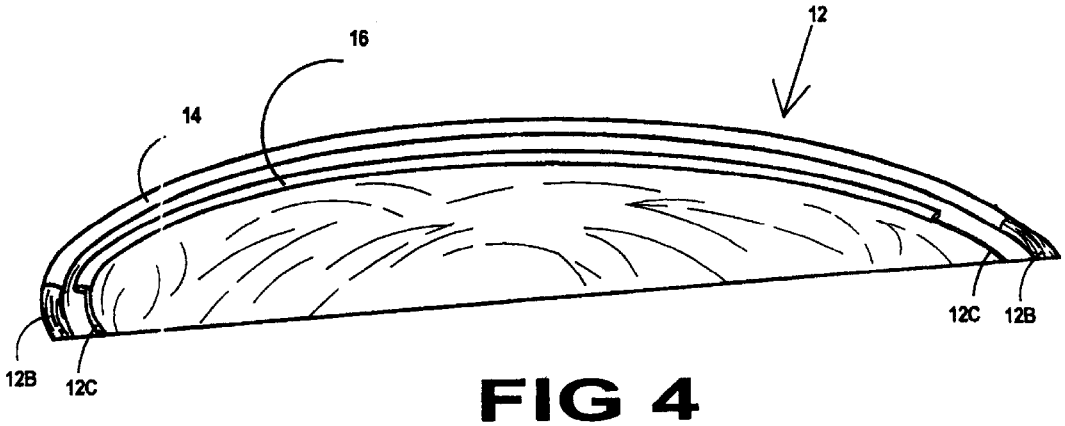
FIG. 4 is a perspective view of the tub liner folded in half in the collapsed position.

Referring to FIG. 4 which is a perspective view of the tub liner (12) folded in half in the collapsed position. When the tub liner (12) is moved to the collapsed position, the fluid is drained from the tub liner (12) and the vertical support members (20) are removed. This will allow the upper edge of the tub liner (12) to collapse downward on the lower edge of the tub liner (12). Then the tub liner (12) can be folded in half as shown, which makes the tub liner (12) very portable.

From FIG. 4 the four gaps between the respective edges of the pair of upper member covers (14) and the pair of lower member covers (16) are apparent. The two gaps between the pair of upper member covers (14) are known as the upper gaps (12B). While the gaps between the pair of lower member covers (16) are known as the lower gaps (12C). The upper gaps (12B) are shown filled with flexible material that is more rigid than the tub liner (12) providing minor lateral support to the upper gaps (12B). The preferred material to use is an etha-foam material. This added material is optional to the invention.

Figure 5:
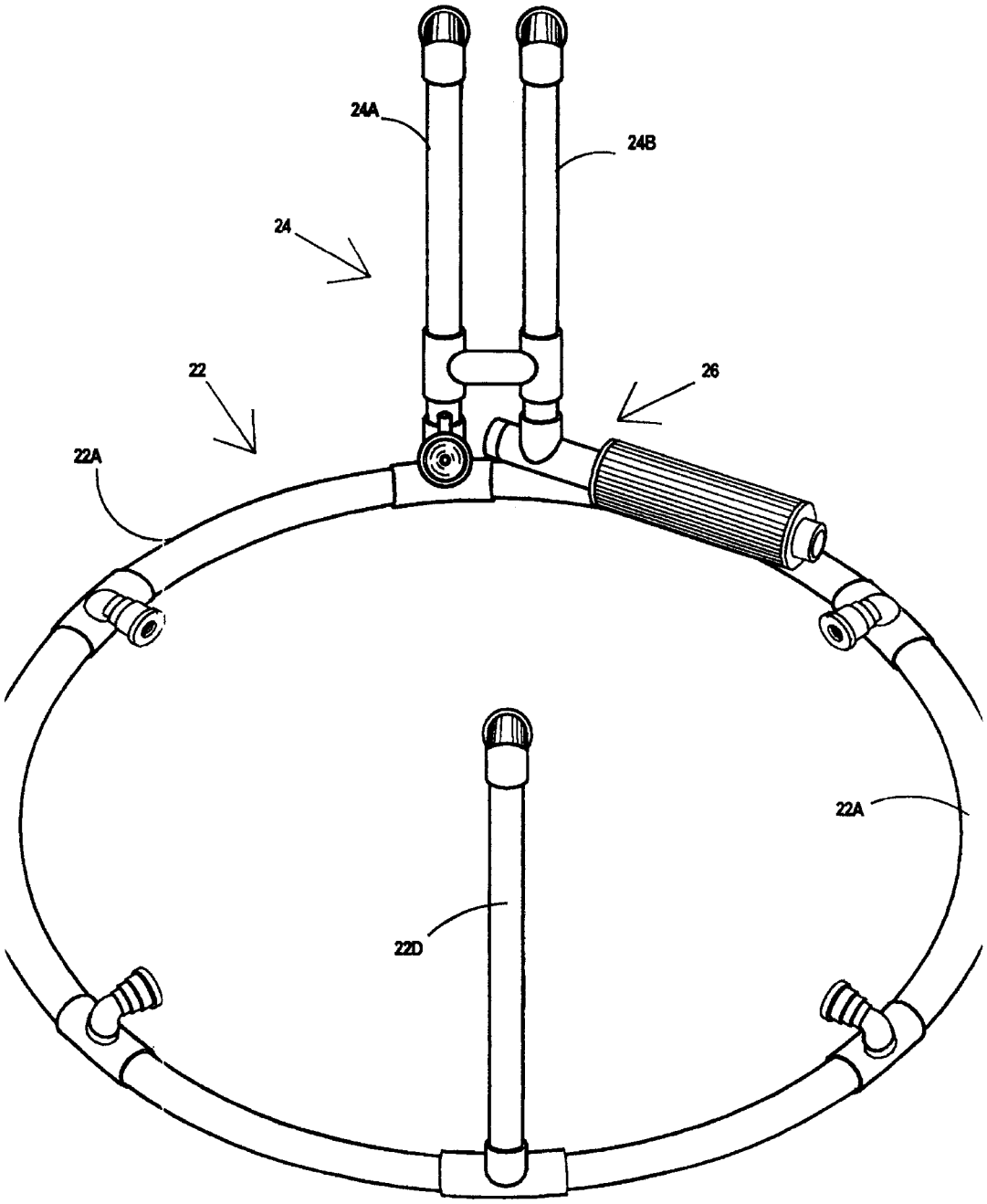
FIG. 5 is a perspective view of the jet assembly removably interconnected to the inlet/outlet assembly.

Referring to FIG. 5 is a perspective view of the jet assembly (22) removably interconnected to the inlet/outlet assembly (24). The jet assembly (22) consists of the two jet assembly members (22A) and the extended jet (22D). The extended jet (22D) removably interconnects the front ends of the jet assembly members (22A) to each other. The extended jet (22D) is movably mounted such that an user can swing in into a downward position to message different parts of his/her body. The inlet/outlet assembly (24) removably interconnects the rear ends of the jet assembly members (22A) to each other. The filter assembly (26) is removably interconnected to the inlet/outlet assembly (24) as shown. The jet assembly (22), inlet/outlet assembly (24) and filter assembly can be fabricated from any strong light weight material such as plastics or metals. Although, the preferred material is a poly vinyl chloride material. The jet assembly (22) is also very portable because it can be readily broken down into small sub-parts.

The portable hot tub (10) further has a jet assembly (22) removably within the tub liner (12) attached to the at least one retaining member (12A). The jet assembly (22) comprises at least four jet assembly members (22A) of which one pair are each connected at one distal end to a rear T-member (24AB) and each connected at opposite distal ends to a pair of jets (22C). A second pair of assembly members (22A) are connected at one distal end to each jet (22C) and connected at opposite distal ends to a front T-member (22DA) of an extended jet (22D). An inlet jet (24D) having a inlet jet aerator nozzle (24DA) is connected to the rear T-member (24AB). The inlet jet (24D) swivels up and down as per bathers performance. A top of the inlet jet (24D) swivels 60 degrees in a right or left direction to shoot water on different parts of bathers body. A portable hot tub (10) having an second tube (24A) of an inlet/outlet assembly (24) is connected at a lower distal end to the rear T-member (24AB) extending upwardly therefrom over the upper member cover (14). The second tube (24A) is removably connected at an upper distal end to an second tube elbow (24AA) extending backwardly therefrom. An inlet hose (30) is removably connected to the second tube elbow (24AA). The portable hot tub (10) further has an first tube (24B) extending upwardly over the upper member cover (14) connecting at a top distal end to an first tube elbow (24BA). A hose nozzle (24BAA) is connected between the first tube elbow (24BA) and an outlet hose (32). An inlet/outlet cross member (24C) securely fastens the second tube (24A) to the first tube (24B) functioning to hold the first tube (24B) in a fixed position.

The jet assembly (22) is fabricated from a material selected from a group consisting of plastics, plastic composites, metals, metal alloys, rubber, rubber composites, poly-vinyl chloride and nylon-vinyl chloride.

Figure 6:
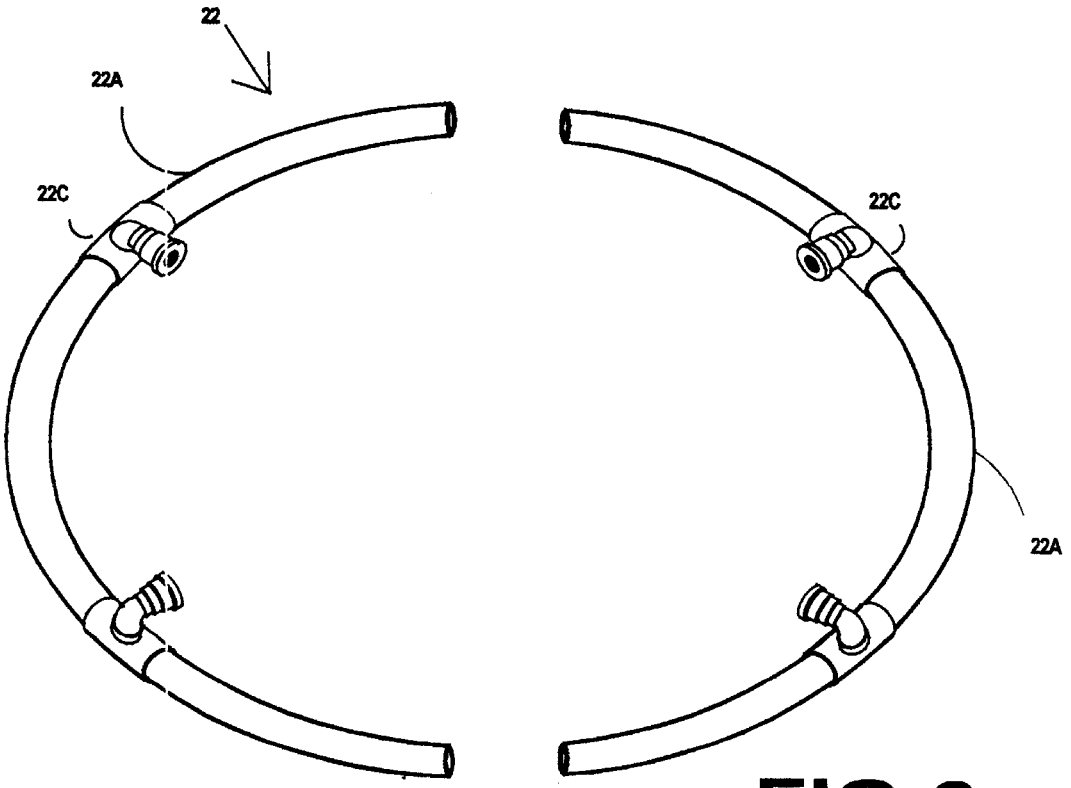
FIG. 6 is a perspective view of the two jet assembly members.

Referring to FIG. 6 which is a perspective view of the two jet assembly members (22A). Both jet assembly members (22A) are of the same hollow tubular configuration having a preferred diameter of 1½ inches. Each of the jet assembly members (22A) has two jets (22C) attached to and extending upward from the top outer surfaces of the jet assembly members (22A). During operation, the jets (22C) create a jet or whirlpool action in the fluid contained within the tub liner (12), by directing the pressurized fluid circulating within each jet assembly member (22A) into the tub liner (12). The two jets (22C) are equally spaced along the length of each of the jet assembly members (22A) to ensure that the jet action is uniform within the tub liner (12).

Figure 7:
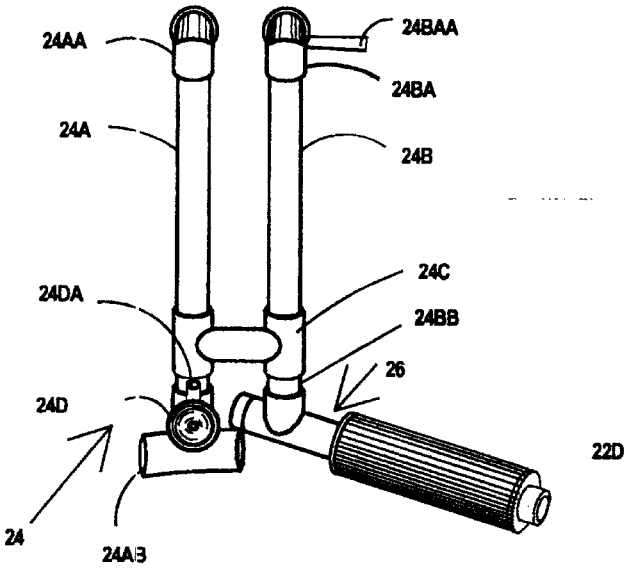
FIG. 7 is a front perspective view of the filter assembly attached to the inlet/outlet assembly.

Referring to FIG. 7 is a front perspective view of the filter assembly (26) attached to the inlet/outlet assembly (24). The inlet/outlet assembly (24) consists of the second tube (24A) and first tube (24B) attached at their respective lower portions by the inlet/outlet cross member (24C). Both the second tube (24A) and first tube (24B) are of a hollow tubular configuration having a preferred diameter of 1½ inches. Attached to the upper end of the second tube (24A) is the second tube elbow (24AA), while attached to the upper end of the first tube (24B) is the first tube elbow (24BA). Both he second tube elbow (24AA) and first tube elbow (24BA) provide a surface to attach a flexible hose to at the top edge of the tub liner (12). Removably interconnected to the first tube bottom end (24BB) is the filter assembly (26).

Extending outward from the front of the second tube (24A) below the inlet/outlet cross member (24C) is the inlet jet (24D) which is optional. During operation, the inlet jet (24D) directs pressurized fluid flowing within the second tube (24A) into the tub liner (12), thereby producing a jet action. The inlet jet (24D) is positioned here so that jet action is generated at a higher level than the jets (22C) can generate. This allows an user to feel the jet action at a higher point on his body. The inlet jet (24D) is exactly the same as the jets (22C) except it has an aerator nozzle (24DA), which is used to aerate the fluid within the tub liner. This accomplished by attaching a flexible hose to the aerator nozzle (24DA) and hanging it over the side of the tub liner (12).

Attach to the lower end of the second tube (24A) is the rear T-member 24AB. The rear T-member (24AB) removably interconnects the rear ends of the two jet assembly members (22A). The rear T-member (24AB) is of a tubular configuration that has a sufficient diameter allowing each rear end of the two jet assembly members (22A) to be removably accepted within the rear T-member (24AB), providing a water tight seal therebetween.

Referring to FIG. 8 which is a perspective view of the extended jet (22D). During operation, the extended jet provides jet action at a higher level than the other jets discussed can generate. The extended jet consists of a tubular member that has a jet attached to its top end and the front T-member (22DA) attached to its lower end. The front T-member (22DA) removably interconnects the front ends of the two jet assembly members (22A). The front T-member (22DA) is of a tubular configuration that has a diameter that allows each forward end of the two jet assembly members (22A) to be removably contained within the front T-member (22DA), providing a water tight seal therebetween.

Figure 9:
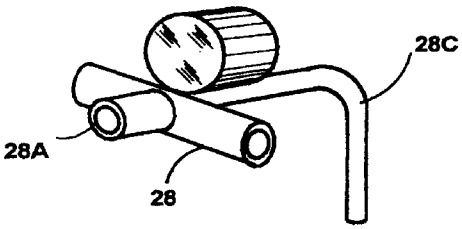
FIG. 9 is perspective view of the inlet/outlet bracket.

Referring to FIG. 9 which is perspective view of the inlet/outlet bracket (28). The inlet/outlet bracket anchor (28C) is a rod member that has a rear curved portion which hooks to the side wall of the tub liner (12) and a threaded front portion. The threaded front portion of the inlet/outlet bracket anchor (28C) passes through a hole in the center of the inlet/outlet bracket (28) and is attached to the complimentary threaded bracket knob (28A). When the inlet/outlet bracket (28) is placed in front of the inlet/outlet assembly (24) and the bracket knob (28A) is tightened, the inlet/outlet assembly (24) is removably secured to the side wall of the tub liner (12) as shown in FIG. 1.

Figure 10:
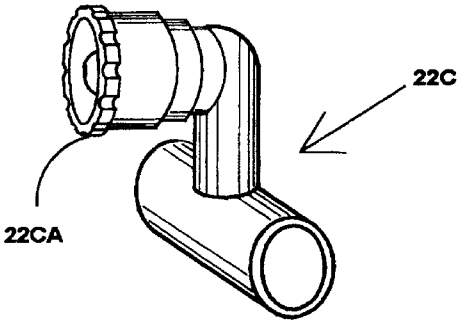
FIG. 10 is a perspective view of the jets.

Referring to FIG. 10 which is a perspective view of the jets (22C). The jets (22C) are a standard adjustable hot tub jet standard in the art. Located on the front edge of the jet is the knurled ring (22CA). The knurled ring (22CA) adjusts the rate of fluid that flows through the jets (22C) during operation. The rate of flow can be either increased or decreased by the direction the knurled ring (22CA) is turned. The extended jet (22D) and the inlet jet (24D) is also similarly adjustable.

Figure 11:
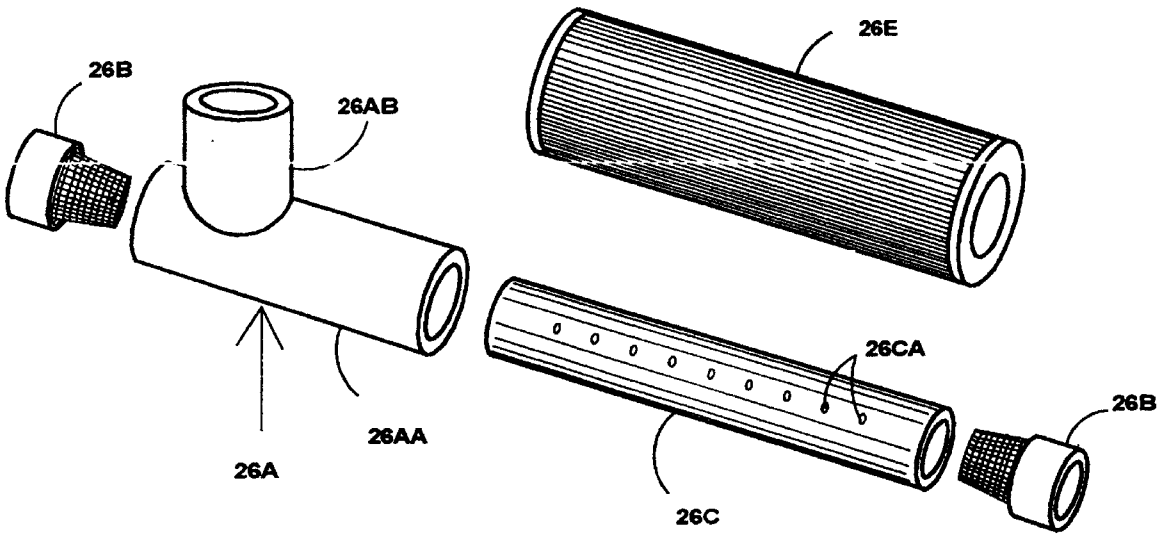
FIG. 11 is an exploded view of the filter assembly.

Referring to FIG. 11 which is an exploded view of the filter assembly (26). The filter assembly consists of the filter T-connector (26A), two filter screens (26B), filter pipe (26C), and filter element (26E).

The filter T-connector (26A) consists of the filter T-connector lower portion (26AA) and filter T-connector upper portion (26AB). The filter T-connector lower portion (26AA) is a tubular member of a diameter so that one of the filter screens (26B) and the filter pipe (26C) can be removably contained within the ends of the filter T-connector lower portion (26A) forming water tight seals therebetween. The filter T-connector upper portion (26AB) is a tubular member which has a length shorter than the filter T-connector lower portion (26AA). The filter T-connector upper portion (26AB) is interconnected and extends outward perpendicularly from the filter T-connector lower portion (26AA). The filter T-connector upper portion (26AB) has a diameter so that the first tube bottom end (24BB) can be removably contained within the top end of the filter T-connector upper portion (26AB) forming a fluid tight seal therebetween.

The filter pipe (26C) is also of a tubular configuration that has a plurality of filter pipe orifices (26CA) through its surface. The filter pipe orifices (26CA) allow fluid to be drawn into the filter pipe (26C) from the filter element (26E). The filter element (26E) is also of a tubular configuration that is configured to slide over the filter pipe (26C). The two filter screens (26B) are short tubular members that have screen elements attached to them. The filter element (26E) and the two filter screens (26B) function to remove the impurities from the fluid that enters the water assembly (26) through them.

When the filter assembly is assembled, the first end of the filter pipe (26C) will be contained within the second end of the filter T-connector lower portion (26AA). The filter element (26E) slides over the filter pipe (26C) and is held in place by one of the filter screens (26B) being contained within the second end of the filter pipe (26C).

During operation, fluid will be drawn into the filter assembly 26 through the two filter screens (26B) and filter element (26E) by the motor/heater unit (36). This configuration provides the filter assembly (26) with three fluid inlets. Having multiple fluid inlets is a safety feature because it reduces the amount of suction felt at each fluid inlet. The industry standard for hot tubs is to have filters with two fluid inlets. Therefore, the portable hot tub (10) having a filter assembly (26) with three fluid inlets is a safety feature beyond industry standards.

The filter assembly (26) is connected to a lower end of the first tube (24B) by a filter T-connector (26A). The filter assembly (26) comprises a filter pipe (26C) having a plurality of filter pipe orifices (26CA) therein. The filter pipe (26C) is attached to the filter T-connector (26A). A filter element (26E) covers the filter pipe (26C). A first filter screen (26B) is connected to an open end of the filter T-connector (26A). A second filter screen (26B) is connected to an open end filter pipe (26C) securing the filter element (26E) thereto.

During operation, the portable hot tub (10) is assembled as shown in FIG. 1. The user attaches a garden hose to the hose nozzle (24BAA) on the first tube (24B). Then the user will then open the valve in the hose nozzle (24BAA) and turn on the garden hose. This will allow fluid to flow down into the first tube (24B) through the filter assembly (26), thereby filing the tub liner (12). The fluid will also flow back through the outlet hose (32) to the motor/heater unit, thereby priming the motor contained within the motor/heater unit (36). When the fluid in the tub liner (12) rises above the level of the jets (22C), the user presses the air button (28B), which will turn on the motor/heater unit (36). The motor heater unit will begin to heat the fluid and pump it through out the system.

Fluid is drawn up through the first tube (24B) through the filter assembly (26). The fluid is then drawn to the motor/heater unit (36), where it is heated and pumped back toward the second tube (24A) through the inlet hose (30). The fluid goes down the second tube (24A) entering the jet assembly (22). The fluid is then pumped through the jet assembly (22), where it is directed out into the tub liner (12) by the various jets of the jet assembly (22). When the tub liner (12) is filled with water, the user shuts off the hose, disconnects the hose and closes the valve in the hose nozzle (24BAA). The motor/heater unit (36) then continues to heat and pump the fluid as described above.

The filter T-connector (26A) is fabricated from a material selected from a group consisting of plastics, plastic composites, metals, metal alloys, rubber, rubber composites, poly-vinyl chloride and nylon-vinyl chloride.

Figure 12:
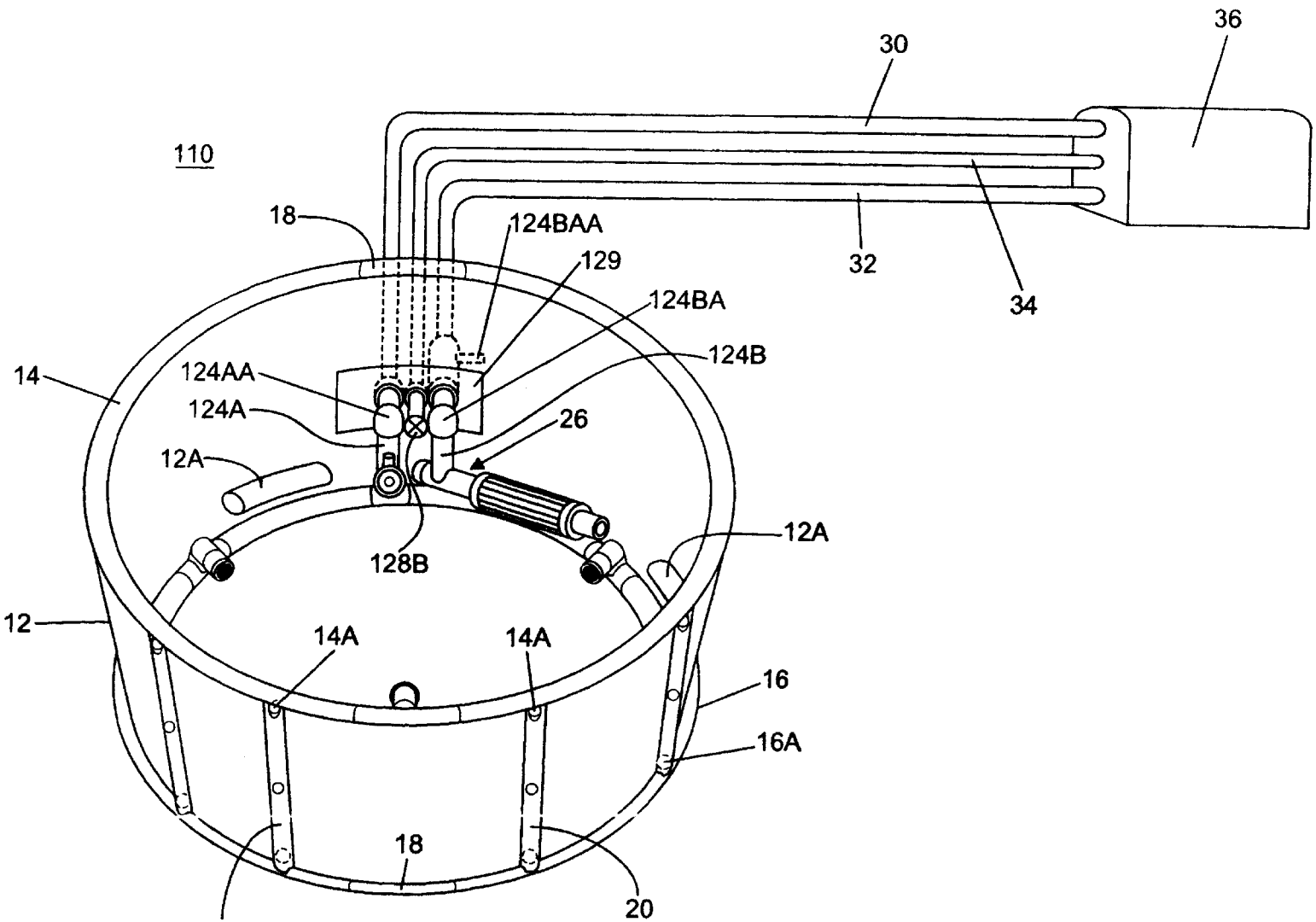
FIG. 12 is a perspective view of the portable hot tub in the ready to use configuration showing the tub liner supported in the upright position exhibiting the second inlet/outlet assembly.
Figure 13:
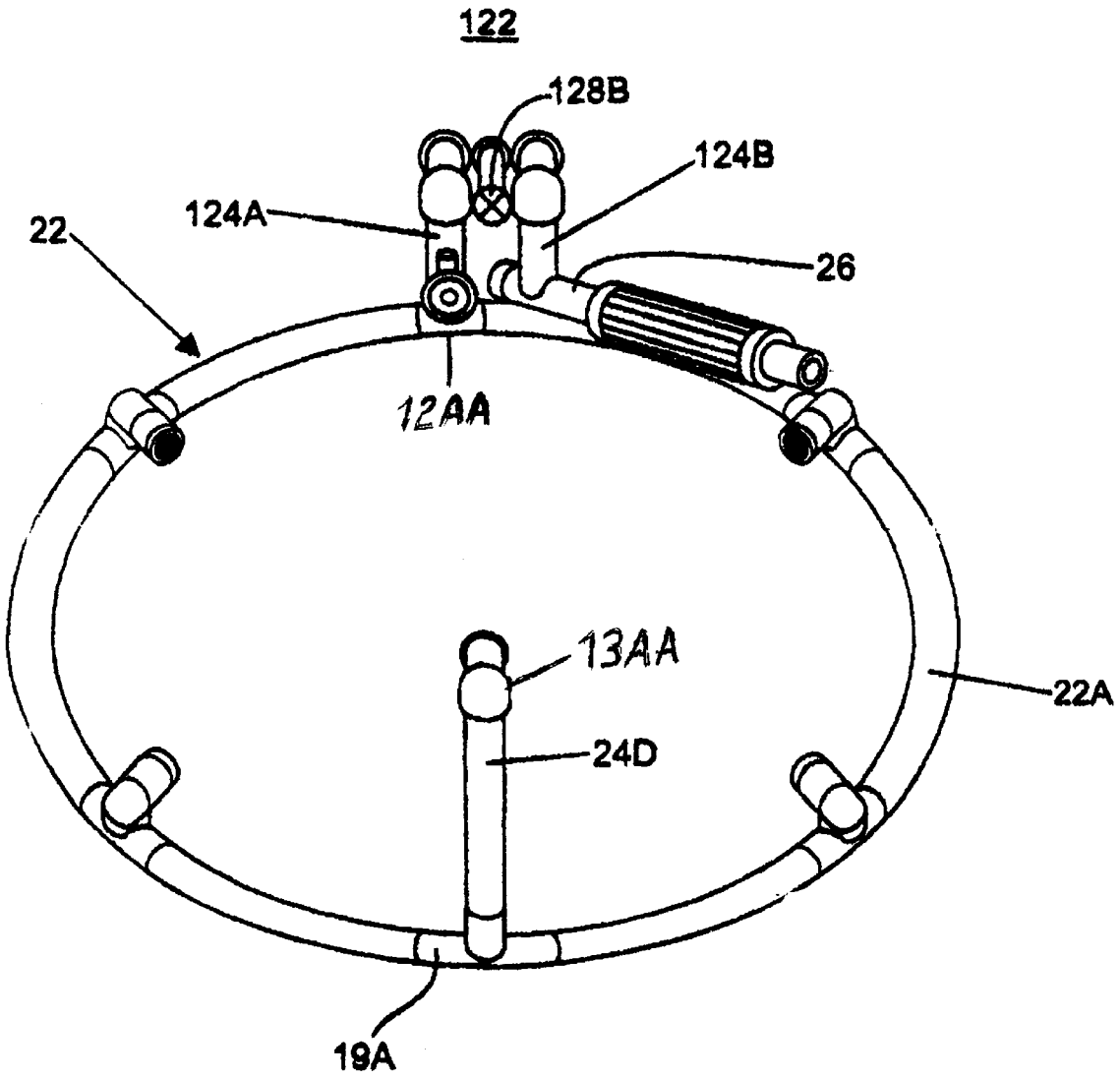
FIG. 13 is perspective view of the jet assembly removably interconnected to the second inlet/outlet assembly.

Referring to FIG. 12 and FIG. 13 which are a perspective view of the portable hot tub in the ready to use configuration showing the tub liner supported in the upright position exhibiting the second inlet/outlet assembly (122) which is similar to the jet assembly (22) with the exception that the second tube (24A) is replaced by the second second tube (124A) which is shorter and connected to a second second tube elbow (124AA) which transcends through the tub liner (12). The first tube (24B) is replaced by the second first tube (124B) which is shorter and connected to a second first tube elbow (124BA) which transcends through the tub liner (12). The second first tube elbow (124BA) is connected to a second hose nozzle (124BAA). The second second tube elbow (124AA) and the second first tube elbow (124BA) are connected to a second connector patch (129) which is hydrodynamically sealed to the tub liner (12) and the outside periphery of the second second tube elbow (124AA) and the second first tube elbow (124BA). The filter assembly (26) is connected to the second first tube (124B). The inlet jet (24D) is connected to the second second tube (124A).

It will be understood that each of the elements described above, or two or more together, may also find a useful application in other types of constructions differing from the type described above.

While the invention has been illustrated and described as embodied in a portable hot tub device, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

I claim:

1. A portable hot tub (10) comprising:

A) a pair of upper member covers (14) removably connectable to each other at distal ends by a pair of sliding lock members (18), each of the upper member covers (14) comprise at least two upper ball members (14A) extending downwardly therefrom;

B) a pair of lower member covers (16) removably connectable to each other at distal ends by a pair of sliding lock members (18), each of the lower member covers (16) comprise at least two lower ball members (16A) extending upwardly therefrom, the upper ball members (14A) and the lower ball members (16A) are complimentary positioned to one another;

C) at least four vertical support members (20) which each comprise a vertical support member slotted end (20A), a vertical support member slanted end (20B), and a vertical support member anchor (20C), each vertical support member (20) is removably insertable into a respective upper ball member (14A) by the vertical support member slotted end (20A), each vertical support member (20) is removably insertable into a respective lower ball member (16A) by the vertical support member slanted end (20B);

D) a tub liner (12) securely fastened around a top periphery to the pair of upper member covers (14) by first horizontal support members (13) which are inserted within a wrap of the tub liner (12) and within the upper member covers (14), the tub liner (12) securely fastened around a bottom periphery to the pair of lower member covers (16) by second horizontal support members (13) which are inserted within a wrap of the tub liner (12) and within the lower member covers (16), the vertical support members (20) functioning to prevent bulging of the tub liner (12), the tub liner further comprises at least one retaining member (12A) which is securely fastened to an inside of a bottom periphery of the tub liner (12);

E) a jet assembly (22) is removably within the tub liner (12) attached to the at least one retaining member (12A), the jet assembly (22) comprises at least four jet assembly members (22A) of which one pair are each connected at one distal end to a rear T-member (24AB) and each connected at opposite distal ends to a pair of jets (22C), a second pair of assembly members (22A) are connected at one distal end to each jet (22C) and connected at opposite distal ends to a front T-member (22DA) of an extended jet (22D), an inlet jet (24D) having a inlet jet aerator nozzle (24DA) is connected to the rear T-member (24AB);

F) an second tube (24A) of an inlet/outlet assembly (24) is connected at a lower distal end to the rear T-member (24AB) extending upwardly therefrom over the upper member cover (14), the second tube (24A) is removably connected at an upper distal end to an second tube elbow (24AA) extending backwardly therefrom, an inlet hose (30) is removably connected to the second tube elbow (24AA);

G) a first tube (24B) extends upwardly over the upper member cover (14) connecting at a top distal end to an first tube elbow (24BA), a hose nozzle (24BAA) is connected between the first tube elbow (24BA) and an outlet hose (32), an inlet/outlet cross member (24C) securely fastens the second tube (24A) to the first tube (24B) functioning to hold the first tube (24B) in a fixed position;

H) a filter assembly (26) is connected to a lower end of the first tube (24B) by a filter T-connector (26A), the filter assembly (26) comprises a filter pipe (26C) having a plurality of filter pipe orifices (26CA) therein, the filter pipe (26C) is attached to the filter T-connector (26A), a filter element (26E) covers the filter pipe (26C), a first filter screen (26B) is connected to an open end of the filter T-connector (26A), a second filter screen (26B) is connected to an open end filter pipe (26C) securing the filter element (26E) thereto;

I) a motor/heater unit (36) is connected to the inlet hose (30) and the outlet hose (32), an air button hose (34) is connected at one end to the motor/heater unit (36) and connected at an opposite end to an air button (28B), when an user depresses the air button (28B) pressurized air enters the air button hose (34) activating/deactivating the motor/heater unit (36).

2. The portable hot tub (10) as described in claim 1, wherein the pair of upper member covers (14) has a larger diameter than the pair of lower member covers (16) providing collapsibility therebetween.

3. The portable hot tub (10) as described in claim 1, wherein the upper member covers (14), the lower member covers (16), and the vertical support members (20) are manufactured from a material selected from a group consisting of plastics, plastic composites, metals, metal alloys, rubber, rubber composites, and poly-vinyl chloride.

4. The portable hot tub (10) as described in claim 1, wherein the tub liner is fabricated from a material selected from a group consisting of plastics, plastic composites, metals, metal alloys, rubber, rubber composites, poly-vinyl and nylon-vinyl.

5. The portable hot tub (10) as described in claim 1, wherein the jet assembly (22) is fabricated from a material selected from a group consisting of plastics, plastic composites, metals, metal alloys, rubber, rubber composites, poly-vinyl chloride and nylon-vinyl chloride.

6. The portable hot tub (10) as described in claim 1, wherein the filter T-connector (26A) is fabricated from a material selected from a group consisting of plastics, plastic composites, metals, metal alloys, rubber, rubber composites, poly-vinyl chloride and nylon-vinyl chloride.

7. A portable hot tub (110) comprising:

A) a pair of upper member covers (14) removably connectable to each other at distal ends by a pair of sliding lock members (18), each of the upper member covers (14) comprise at least two upper ball members (14A) extending downwardly therefrom;

B) a pair of lower member covers (16) removably connectable to each other at distal ends by a pair of sliding lock member (18), each of the lower member covers (16) comprise at least two lower ball members (16A) extending upwardly therefrom, the upper ball members (14A) and the lower ball members (16A) are complimentary positioned to one another;

C) at least four vertical support members (20) which each comprise a vertical support member slotted end (20A), a vertical support member slanted end (20B), and a vertical support member anchor (20C), each vertical support member (20) is removably insertable into the upper ball members (14A) by the vertical support member slotted end (20A), each vertical support member (20) is removably insertable into the lower ball members (16A) by the vertical support member slanted end (20B);

D) a tub liner (12) is securely fastened around a top periphery to the pair of upper member covers (14) by horizontal support members (13) which are inserted within a wrap of the tub liner (12) within the upper member covers (14), the tub liner (12) is securely fastened around a bottom periphery to the pair of lower member covers (16) by horizontal support members (13) which are inserted within a wrap of the tub liner (12) within the lower member covers (16), the vertical support member anchors (20C) securely fasten to a middle of the tub liner (12) functioning to prevent bulging thereof, the tub liner (12) further comprises at least one retaining member (12A) which is securely fastened to an inside of a bottom periphery of the tub liner (12);

E) a jet assembly (122) is removably within the tub liner (12) attached to the at least one retaining member (12A), the jet assembly (22) comprises at least six jet assembly members (22A) of which a first pair are each connected at one distal end to a rear T-member (24AB) and each of the first pair of six jet assembly members (22A) are connected at opposite distal ends to a first pair of jets (22C), a second pair of assembly members (22A) are connected at one distal end to each of the first pair of jets (22C) and the second pair of assembly members (22A) are connected at opposite distal ends to a second pair of first pair of jets (22C), a third pair of assembly members (22A) are connected at one distal end to each of the second pair of jets (22C) and connected at opposite distal ends to a front T-member (22DA) of an extended jet (22D), an inlet jet (24D) having a inlet jet aerator nozzle (24DA) is connected to the rear T-member (24AB);

F) a primary tube (124A) of an inlet/outlet assembly (24) is connected at a lower distal end to the rear T-member (24AB) extending upwardly therefrom, the second primary tube (124A) is removably connected at an upper distal end to an second primary tube elbow (124AA) extending backwardly therefrom through a second connector patch (129) which is sealably connected to the tub liner (12) and to the tube elbow (124AA), an inlet hose (30) is removably connected to the second primary tube elbow (124AA);

G) a first tube (124B) extends upwardly connecting at a top distal end to an first tube elbow (24BA) extending backwardly therefrom through a second connector patch (129) which is sealably connected thereto, a second hose nozzle (124BAA) is connected between the second first tube elbow (124BA) and an outlet hose (32), an inlet/outlet cross member (24C) securely fastens the second tube (24A) to the second first tube (124B) functioning to hold the second first tube (124B) in a fixed position;

H) a filter assembly (26) is connected to a lower end of the first tube (24B) by a filter T-connector (26A), the filter assembly (26) comprises a filter pipe (26C) having a plurality of filter pipe orifices (26CA) therein, the filter pipe (26C) is attached to the filter T-connector (26A), a filter element (26E) covers the filter pipe (26C), a first filter screen (26B) is connected to an open end of the filter T-connector (26A), a second filter screen (26B) is connected to an open end filter pipe (26C) securing the filter element (26E) thereto;

I) a motor/heater unit (36) is connected to the inlet hose (30) and the outlet hose (32), an air button hose (34) is connected at one end to the motor/heater unit (36) and connected at an opposite end to an air button (28B), when an user depresses the air button (28B) pressurized air enters the air button hose (34) activating/deactivating the motor/heater unit (36).

8. The portable hot tub (10) as described in claim 7, wherein the pair of upper member covers (14) has a larger diameter than the pair of lower member covers (16) providing collapsibility therebetween.

9. The portable hot tub (10) as described in claim 7, wherein the upper member covers (14), the lower member covers (16), and the vertical support members (20) are manufactured from a material selected from a group consisting of plastics, plastic composites, metals, metal alloys, rubber, rubber composites, and poly-vinyl chloride.

10. The portable hot tub (10) as described in claim 7, wherein the tub liner (12) is fabricated from a material selected from a group consisting of plastics, plastic composites, metals, metal alloys, rubber, rubber composites, poly-vinyl and nylon-vinyl.

11. The portable hot tub (10) as described in claim 7, wherein the second jet assembly (122) is fabricated from a material selected from a group consisting of plastics, plastic composites, metals, metal alloys, rubber, rubber composites, poly-vinyl chloride and nylon-vinyl chloride.

12. The portable hot tub (10) as described in claim 7, wherein the filter T-connector (26A) is fabricated from a material selected from a group consisting of plastics, plastic composites, metals, metal alloys, rubber, rubber composites, poly-vinyl chloride and nylon-vinyl chloride.

13. The portable hot tub (10) as described in claim 1, wherein the inlet jet (24D) swivels up and down as per bathers performance.

14. The portable hot tub (10) as described in claim 1, wherein a top of the inlet jet (24D) swivels 60 degrees in a right or left direction to shoot water on different parts of bathers body.

15. The portable hot tub (10) as described in claim 1, wherein at least one holder strip (11) snap into water supply tubes (22) holding them together in one complete circle.

16. The portable hot tub (10) as described in claim 1, wherein at least one holder strip (11) is manufactured from plastic or fabric.

17. The portable hot tub (10) as described in claim 1, wherein the jet assembly (22) is raisable in an upward and downward direction by a bather to achieve hydrotherapy upon differing parts of a body.

* * * * *